United States Patent [19]

Undin et al.

[11] Patent Number: 4,726,266

[45] Date of Patent: Feb. 23, 1988

[54] PAIR OF PLIERS

[75] Inventors: Hans Undin, Åkersberga; Hans Wiener, Täby, both of Sweden

[73] Assignee: C. A. Weidmuller GmbH & Co., Detmold, Fed. Rep. of Germany

[21] Appl. No.: 819,539

[22] Filed: Jan. 16, 1986

[30] Foreign Application Priority Data

Feb. 6, 1985 [SE] Sweden ..... 8500536

[51] Int. Cl.[4] ..... B25B 7/06

[52] U.S. Cl. ..... 81/416; 81/421; 81/342; 81/367

[58] Field of Search ..... 81/342, 350, 367, 368, 81/369, 370, 371, 372, 373, 374, 375, 376, 378, 379, 380, 381, 382, 383, 421–424, 424.5, 426, 426.5, 427.5, 415, 416, 418

[56] References Cited

U.S. PATENT DOCUMENTS

| | | | |
|---|---|---|---|
| 1,762,562 | 6/1930 | Roberts | 81/390 |
| 2,099,246 | 11/1937 | Raffles | 81/492 |
| 2,341,654 | 2/1944 | Richter | 81/374 |
| 2,359,083 | 9/1944 | Carlson | 81/418 |
| 3,487,524 | 1/1970 | Filia | 81/421 |
| 4,353,240 | 10/1982 | Undin et al. | 81/421 |

*Primary Examiner*—Robert P. Olszewski
*Assistant Examiner*—Bradley I. Vaught
*Attorney, Agent, or Firm*—Karl F. Ross; Herbert Dubno

[57] ABSTRACT

In a pair of pliers where at least one of two shanks which carry jaws is built up of two spaced side-plates, is in at least one of the shanks a tapered section arranged rearwardly of a pivot point where the shank is attached to the other one. By the rearward location, which also allows a less steep taper, the tapered section is more spaced from the pivot point, whereby the danger of rupture upon heavy loading is diminished. Also the handles may be built up of spaced side-plates between which a stem portion of a protective grip with T-shaped cross-section is inserted.

9 Claims, 4 Drawing Figures

STATE OF ART

STATE OF ART

PAIR OF PLIERS

FIELD OF THE INVENTION

The invention relates to a pair of pliers comprising a first handle and a second handle; a first shank member drivable by the first handle and a second shank member connected to the second handle; a connecting member pivotally connecting the first shank member at a first pivot point thereon with the second shank member; an extension on the first shank member extending rearwardly of the first pivot point and to which, at a rear end thereof, the second handle is pivotally attached in a second pivot point; a pair of jaws mounted on said shank members, at least one of the jaws having a mounting flap and at least one of the shank members consisting of two spaced apart side plates, at least one of which has a tapered section forming a transition from a greater spacing which defines a forward reception chamber for the flap to a lesser spacing.

In the present description and in the attached claims "forward", "ahead", etc. means toward the free forward ends of the shank members and "rear" etc. means toward the free rear ends of the handles.

BACKGROUND OF THE INVENTION

Since tapered section or sections have been avoided heretofore in pliers exclusively ahead of the first pivot point, i.e. between the forward end of the respective shank and the first pivot point, and as close to the latter as possible, in order to minimize the overall length of the shank member, since the reception chamber always must have a given length and an increased distance between the rear end of the reception chamber and the first pivot point would mean an increased overall length of the tool.

However, it has been found that when the tool is heavily loaded, most ruptures occur in the tapered zone. Firstly, the material of the side plates is there weakened by the bending operation by which the taper was produced and some microscopic fissures may have arisen, and, secondly, the power component in the couple "power times path" achieves its maximum value when the path is at its minimum value. Also in order not to make the tool longer than necessary, the taper is usually made rather steep, i.e. along a very short path only, which also increases the danger of fissures being formed.

OBJECTS OF THE INVENTION

It is an object of the invention to provide an improved tool of the type described wherein the danger of rupture at the tapered section is reduced.

Another object of the invention is to provide a tool of the type described with novel protective grips on the handles in which a honeycomb structure gives a reinforcing effect.

SUMMARY OF THE INVENTION

In accordance with the present invention, in a pair of pliers of the type described the tapered section is located on the rearward extension of the first shank member between the first and the second pivot points and at a greater distance from the first pivot point than the spacing of the first pivot point from a rear end of the respective jaw. At least one of the two handles may also consist of two side plate with a free space between them and can be provided with a protective grip, e.g. of plastic, having the cross-sectional shape of a T with a stem part projecting into the free space and a beam part covering the outer peripheral edges of the side plate.

As the tapered section is arranged rearwardly of the first pivot point, an increase of its spacing from the first pivot point does not increase the overall length of the tool whose handles extend well beyond the rear end of the rearward extension of the first shank member. However, due to this increased distance of the tapered section from the first pivot point the power component in the above mentioned couple "power time path" decreases, because the path component has been increased, so that the load on the shank at the respective location is reduced. Moreover, the taper can also be made less steep, i.e. the taper can extend along a longer path. The protective grips of the invention demand less material than conventional plastic covers enclosing a metal handle from all sides, and they may be firmly held in place by spacers which anyway are provided to connect the two side plates of the respective handle at selected locations.

BRIEF DESCRIPTION OF THE DRAWING

For a better understanding of the invention, reference should be made to the accompanying drawing and descriptive matter in which there is illustrated and described a conventional pair of pliers of the respective type and a novel pair of pliers according to the invention.

In the drawing.

SPECIFIC DESCRIPTION

Figure 1:
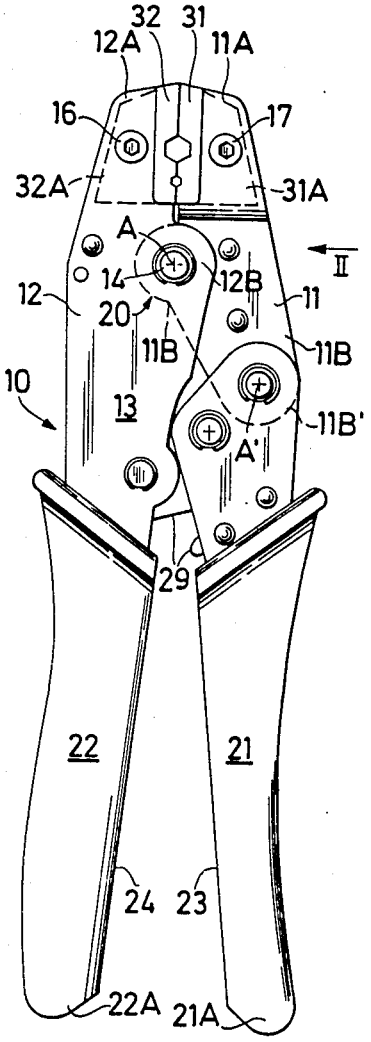
FIG. 1 is an elevational view of a conventional pair of pliers of the type described.
Figure 2:
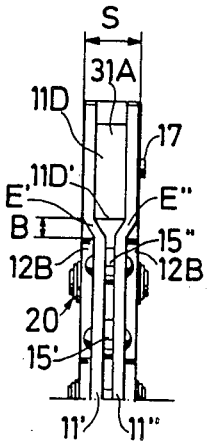
FIG. 2 is an elevational view in the direction of arrow II in FIG. 1 of the forward part of the tool of FIG. 1.
Figure 3:
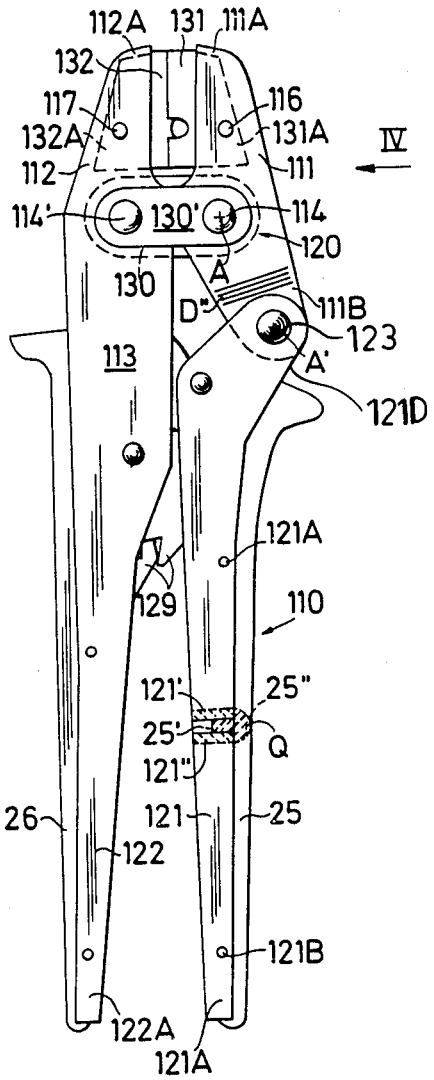
FIG. 3 is an elevational view corresponding to FIG. 1 of pair of pliers according to the present invention.
Figure 4:
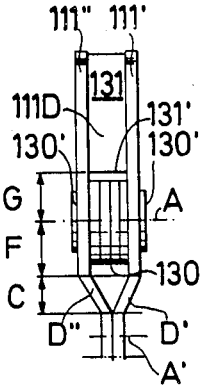
FIG. 4 is an elevational view corresponding to FIG. 2 in the direction of arrow IV in FIG. 3 of the forward part of the tool of FIG. 3.

Parts in FIGS. 3 and 4 corresponding to parts in FIGS. 1 and 2 are generally designated by reference numerals increased by 100 over the numerals for these parts in FIGS. 1 and 2.

A conventional pair of pliers 10 comprise according to FIGS. 1 and 2 a first shank member 11, a second shank member 12, a first handle 21 and a second handle 22. The shank members have free forward ends 11A, 12A and the handles have free rear ends 21A, 22A. The shank members have jaws 31, 32 of a pair of replaceable jaws mounted close to said free ends 11A, 12A. The second shank member 12 and the second handle 22 are merged into a rigid structural unit 13. The handles 21, 22 are provided with protective grips 23, 24 e.g. of plastic in the form of coverings which totally enclose the respective handle from all sides.

The first shank member 11 has a rearward extension 11B and is in a first pivot point A pivotally attached to the structural unit 13 with the aid of connecting member 20. The connecting member 20 comprises two projections 12B (of which only one can be seen in FIG. 1) on the second shank 12 or the unit 13, and two projections 11B (of which only one can be seen in FIG. 1) on the first shank member 11, and a connecting pin 14 passing through aligned openings in all four of said projections. At a second pivot point A', at the rear end of the rearward extension 11B, the first handle 21 is pivoted to the first shank 11.

Both shank members 11, 12 and both handles 21, 22 are built up of two side-plates such as 11', 11" (FIG. 2) which are held at a selected spacing by spacers such as 15', 15". The jaws 31, 32 comprise mounting flaps 31A, 32A provided with openings for the passage of retainer screws 16, 17 anchored in the shank members 11, 12.

The mounting flaps 31A, 32A are in both shank members 11, 12 inserted in a free space defined by the spacers between the two side plates. In the whole unit 13 there is a continuous free space corresponding to the thickness of the mounting flap 32A, which means that each side plate of the unit 13 lies as a whole in a single plane. The side plates 11', 11" of the first shank member 11 lie generally closer one to another than the side plates of the unit 13, so that the shank member 11 can be accommodated between the two projections 12A. In order that a sufficiently wide reception chamber 11D for the mounting flap 31A be obtained under such circumstances, each of the two side-plates 11', 11" is provided with a tapered section E', E" made as short as possible (distance B) and located between the rear end 11D' of the reception chamber 11D and the connecting member 20 or, more specifically, the two projections 11B. Thanks to these tapered zones E', E", the outer lateral faces of the tool never are more spaced one from another than by the distance S at the location of the reception chamber 11D. In the free space between the side plates of the unit 13 and of the first handle 21 a locking mechanism 29 is arranged which in the present context does not need to be described more in detail.

According to FIGS. 3 and 4, a tool 110 of the invention has a first shank member 111 with a free forward end 111A, a second shank member 112 with a free forward end 112A, a first handle 121 with a free forward end 121D and a free rear end 121A and a second handle 122 with a free rear end 122A. The second shank member 112 and the second handle 122 are rigidly connected into a structural unit 113. The shank members 111, 112 carry jaws 131, 132 which have mounting flaps 131A, 132A accommodated in a first reception chamber between the two side plates and where they are retained with the aid of screws 116, 117 passing through holes in the shanks and in the mounting flaps.

The connecting member 120 comprises a pivotal inner link member 130 located in the free space between the two side plates 111', 111" of the first shank 111 and the width of which corresponds to the width of said free space, and two thin outer link members 130' of which only one is shown in FIG. 3 and which are located adjacent the outer faces of the side-plates. The free space defines a second reception chamber, continuous with the first one. The link members 130, 130' are, with the aid of a first pivot pin 114 connected to the first shank 111 and, with the aid of another pivot pin 114', to the second shank 112, i.e. the unit 113. The first pivot pin 114 defines the first pivot point A.

Rearwardly of the connecting member 120, and close to the second pivot point A', tapered sections D', D" are arranged in both side plates 111', 111" of the first shank member 111. The tapered sections D', D" extend along a path C which can be longer than the path B in FIG. 2 without increasing the overall length of the tool; consequently, the taper may be less steep. The distance F of the beginning of the tapered sections D', D" from the first pivot point A and first pivot pin 114 is longer than the distance G between the rear end 131' of the jaw 131 and said pivot point A.

The handles 121, 122 are also built up of two side plates such as 121', 121", held apart by spacers such as 121B, 121C, and are provided with protecting grips 25, 26 e.g. of insulating plastics. The grips have a substantially T-shaped cross-section Q with a stem 25' projecting into the free space between the side plates 121', 121" and a beam 25" which covers or encloses the outer peripheral edges of the said two side plates. Pins, e.g. said spacers 121B, 121C, passing through the side plates 121', 121" and through the stem 25" may retain the grips 25, 26. The honeycomb structure of the handles with the T-shaped grips has a reinforcing effect.

The free space in the first shank member 111 continues with undiminished width rearwardly of the rear end of the first reception chamber 111D (rear end 131' of the jaw 131), providing thus a second reception chamber with sufficient width for an inner link member 130. The location of the tapered sections D', D" ahead of the second pivot point A' and a second pivot pin 123 allows for the side plates of the first handle 121 to have substantially the same spacement as the side plates in the forward portion of the first shank member 111, so that also in this tool e.g. a locking mechanism 129 may be accommodated between the side plates of the first handle 121 and of the structural unit 113.

It will be recognized that the tool 110 also may be provided with a connecting member of the kind shown in the tool 10 in FIG. 1 (consider e.g. the links 130 or 130' rigidly attached to the unit 113) and that, at the price of a constructional asymmetry, which is functionally irrelevant, a tapered section twice as deep as shown, may be provided in one of the two side-plates only, the other side plate remaining planar.

We claim:

1. A pair of pliers comprising:

two shank members having free forward ends and pivotally joined together by a connecting member, at least one of the shank members being built-up of two side plates spaced apart along at least a part of their extension;

a pair of jaws carried by the shank members at respective forward ends thereof, at least one of the jaws having a mounting flap for attachment to the said at least one of the shank members; and a pair of handles, each operatively connected to one of the shank members, said side plates being in the region of said free forward ends spaced apart so as to define between them a first reception chamber for said mounting flap of said at least one of said jaws, and continuing from said reception chamber rearwardly toward a free end of the respective shank with undiminished spacing along a sufficiently long path so as to define adjacently to the first reception chamber a second reception chamber for accommodating said connecting member, at least one of the side plates having rearwardly of the second reception chamber a tapering section of selected length defining a transition zone to a section of reduced spacing of the two side plates, a first pivot pin member passing through the connecting member and at least one of the side plates in the region of the second reception chamber for pivotal attachment of the shank member to the connecting member, and a second pivot pin member passing through one of the handles at a free forward end thereof and through at least one of the side plates in the said section of reduced spacing for the pivotal attachment of said handle to said shank member.

2. The pair of pliers defined in claim 1 wherein the other shank member and the other handle are rigidly connected so as to define on rigid structural unit and the tapered section or sections are provided exclusively in the first-mentioned shank member.

3. The pair of pliers defined in claim 1 wherein at least one of the handles consisting of two side plates with a free space between them is provided with a gripping cover, wherein said cover is in cross-section T-shaped with a stem portion mounted in said free space and a beam portion covering the two side plates on their outer peripheries.

4. The pair of pliers defined in claim 1, wherein said tapering section begins at a distance from the first pivot pin member which is greater than the distance between a rear end of the jaw carried by the respective shank member and the first pivot pin member.

5. The pair of pliers defined in claim 1, wherein both said side plates are provided with tapering sections.

6. The pair of pliers defined in claim 1, wherein the spacing of said two side plates in the section of reduced spacing is zero.

7. The pair of pliers defined in claim 1 wherein said connecting member is a link member which is pivotally attached to the other shank member.

8. The pair of pliers defined in claim 7 wherein at least one outer link member is provided adjacent an outer face of the respective side plate.

9. The pair of pliers defined in claim 1 wherein the first and the second reception chambers are continuous.

* * * * *